US005687775A

United States Patent [19]

Thompson et al.

[11] Patent Number: 5,687,775

[45] Date of Patent: Nov. 18, 1997

[54] WOVEN FABRIC MADE OF PLASTIC MESH NETTING

[75] Inventors: Kani Bynum Thompson; Cheryl Bynum, both of Ransom Canyon, Tex.

[73] Assignee: Bynum Concepts, Inc., Lubbock, Tex.

[21] Appl. No.: 640,477

[22] Filed: May 1, 1996

[51] Int. Cl.[6] ..... D03D 15/00

[52] U.S. Cl. ..... 139/426 R; 139/383 R; 442/2; 442/49

[58] Field of Search ..... 428/225, 229, 428/255, 257, 34.8, 36.1, 36.3, 36.9; 442/2, 49; 139/383 R, 426 R

[56] References Cited

U.S. PATENT DOCUMENTS 2,817,865 12/1957 Arioli .
2,910,710 11/1959 Corrington et al. .
3,597,299 8/1971 Thomas et al. .
4,606,964 8/1986 Wideman .
5,022,517 6/1991 Benitez .
5,343,776 9/1994 Falco ..... 428/36.1
5,385,766 1/1995 Ferre ..... 428/36.1
5,412,830 5/1995 Girardot et al. .
5,413,148 5/1995 Mintz et al. ..... 428/34.8
5,465,452 11/1995 Girardot et al. .
5,491,864 2/1996 Tuthill et al. .

*Primary Examiner*—James J. Bell
*Attorney, Agent, or Firm*—Madan & Morris, PLLC

[57] ABSTRACT

The present invention provides a relatively non-porous, hydrophobic woven fabric comprising interwoven strands of open celled, plastic mesh netting.

24 Claims, 3 Drawing Sheets

WOVEN FABRIC MADE OF PLASTIC MESH NETTING

FIELD OF THE INVENTION

The present invention relates to woven fabrics made of plastic mesh netting.

BACKGROUND OF THE INVENTION

Woven fabric has been made from a variety of materials, including cotton, silk, and wool. Woven fabrics are used to construct a large number of items, including clothing, upholstery, and rugs. In a number of applications, it would be desirable for the woven fabric to be (a) relatively non-porous, to avoid absorbing and/or retaining dirt and debris, and/or (b) water repellant or water resistant. An example is a woven fabric cleaning implement for removing dirt and dead skin from the user's body during bathing and showering. Another example is a woven fabric rug or upholstery to be used in a pool or other water intensive environment.

SUMMARY OF THE INVENTION

The present invention provides a relatively non-porous, hydrophobic woven fabric comprising interwoven strands of open celled, plastic mesh netting.

DETAILED DESCRIPTION OF THE INVENTION

The netting that may be used to construct the woven fabric of the present invention may be substantially any relatively flexible, open-celled netting. The netting should be open-celled netting so that water, e.g., from a shower, faucet, or pool, can run through and clean the strands of netting in the woven fabric. Preferably, the netting should be relatively non-porous so that dirt and debris do not become trapped in pores in the netting, and so that the scrubber will dry rapidly. The netting preferably should be hydrophobic for ease in cleaning and drying. It is also preferable for the netting to be elastic so that the netting can be prestretched to manipulate the volume of the fabric. Elasticity also is helpful because, if the netting is stretched during use, it will return to its original shape after stretching.

Preferred netting for use in the present invention is diamond mesh polyethylene netting, which may be obtained from a number of manufacturers. One such manufacturer is Nalle Plastics, Inc., 220 E. St. Elmo Rd., Austin, Tex. 78745-1218.

Figure 1:
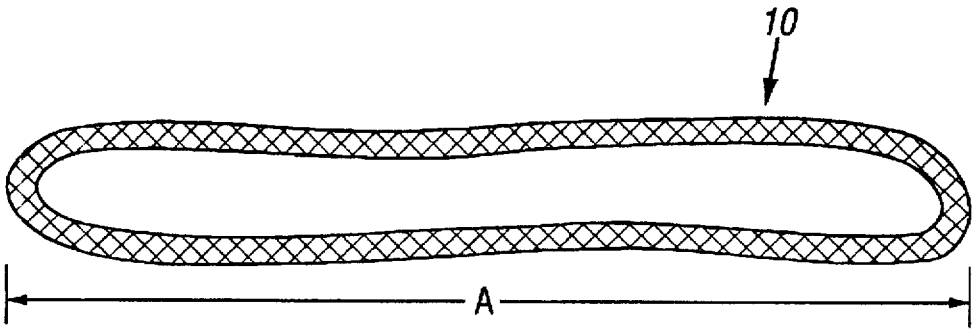
FIG. 1 is a schematic view of a stretched, folded loop of netting used to make the strands that are interwoven into fabric according to a preferred embodiment of the present invention.

Referring to FIG. 1, the netting preferably should be tubular so that loops 10 of the tubular netting can be cut. It is not necessary to use tubular netting or loops to construct the woven fabric of the present invention. The woven fabric could be constructed of single layered strands of open celled netting. However, tubular netting has a number of advantages, and therefore is preferred.

Figure 2:
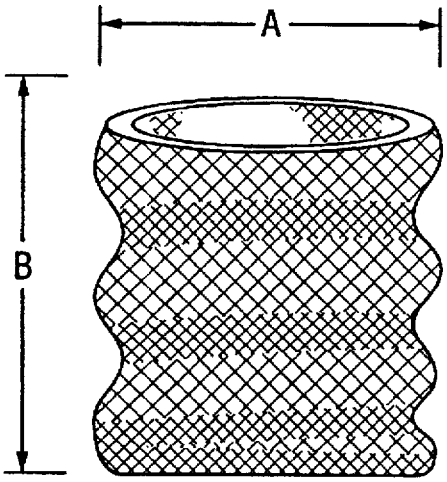
FIG. 2 is a diagram of a tubular length of mesh netting in the process of being folded or bunched along its width to form a loop of netting.

In order to make a suitable fabric, each strand of netting (14, 16 in FIG. 5) preferably should have more bulk than a single layer loop 10 of netting would provide. In order to provide such bulk, the loops 10 preferably should have a width (measured along the axis of the tube of netting, designated B in FIG. 2) sufficient to fold or layer the netting upon itself, as depicted in FIG. 2 and shown in cross section in FIG. 3. The width B of the loops 10 may vary depending upon the type of netting used and the ultimate use of the woven fabric.

In a preferred embodiment, the loops of netting, themselves, comprise continuous tubes of netting. In other words, a "loop" of netting actually is a continuous tube of netting, similar to a hose or a pipe, that forms a continuous loop. Loops of netting having a "pipe" construction hereinafter are defined as "tubular loops." If tubular loops of netting are used for loops 10, then the "diameter" or cross-section of the tubes, when flattened, should be sufficient to permit the tube to be layered upon itself as shown in FIG. 3.

The length or diameter (A in FIGS. 1 and 2) of the loops (measured perpendicular to the axis of the tube of netting) before stretching (if any) may vary depending on the diameter of the tubing available and the desired size of the woven fabric. Where the woven fabric product will be relatively small, such as a "washcloth," the netting used preferably is 19 inch Layflat measure or size, which has an unstretched diameter of about 1½ inches.

Stretching of the netting is preferred in order to predetermine the width or length of the woven fabric product and to avoid undesirable stretching of the woven fabric product after construction. Stretching of the loops can be accomplished using any known means. For example, referring to FIG. 6, a mesh fabricator 12 may be used. The mesh fabricator 12 preferably is made of metal or other relatively smooth, strong material having a "U" shape which is slightly smaller at the bottom of the "U" than at the legs of the "U". The loops of netting (not shown) may be urged over the narrower bottom of the "U" and along the legs of the "U" to a point where the distance between the legs is sufficient to stretch the loop. Preferably, the netting should be stretched to approximately ten times its unstretched length. For example, a 5 inch wide loop of diamond mesh polyethylene netting having a 1½ inch unstretched diameter preferably should be stretched until it has a diameter of about 16 inches.

Figure 3:
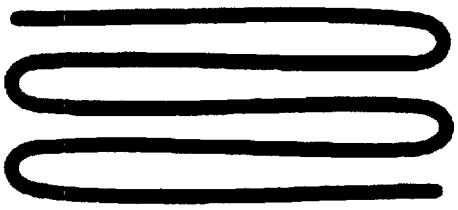
FIG. 3 is a cross section of the loop of netting in FIG. 1 after being completely folded or bunched.
Figure 4:
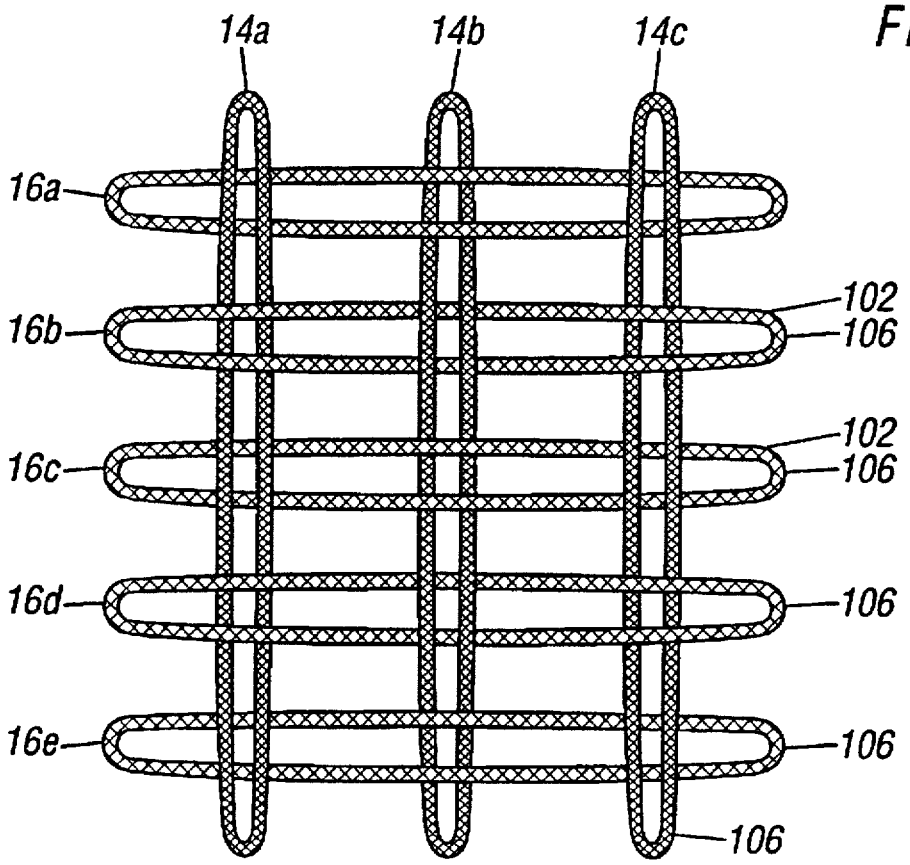
FIG. 4 is a schematic depiction of a preferred weave pattern for the woven fabric of the present invention.

After the loops are folded or layered onto themselves, as shown in FIG. 3 and in cross section in FIG. 4, the loops preferably should be stretched to a desired length. Thereafter, the stretched loops are ready to be interwoven into the fabric of the present invention. The fabric of the present invention may be woven in substantially the same patterns as those in which traditional fabrics are woven. A preferable weave pattern is shown in FIG. 4. As seen in FIG. 4, strands of netting 14*a–c* are oriented substantially parallel to one another to form a first set of strands. A second set of strands of netting 16*a–e* are oriented substantially parallel to one another and substantially perpendicular to the first set of strands 14*a–c*. The strands in the first set 14*a–c* are woven alternately over and under adjacent strands in the second set 16*a–e* to form a "grid" weave pattern, such as that shown in FIG. 4.

Figure 5:
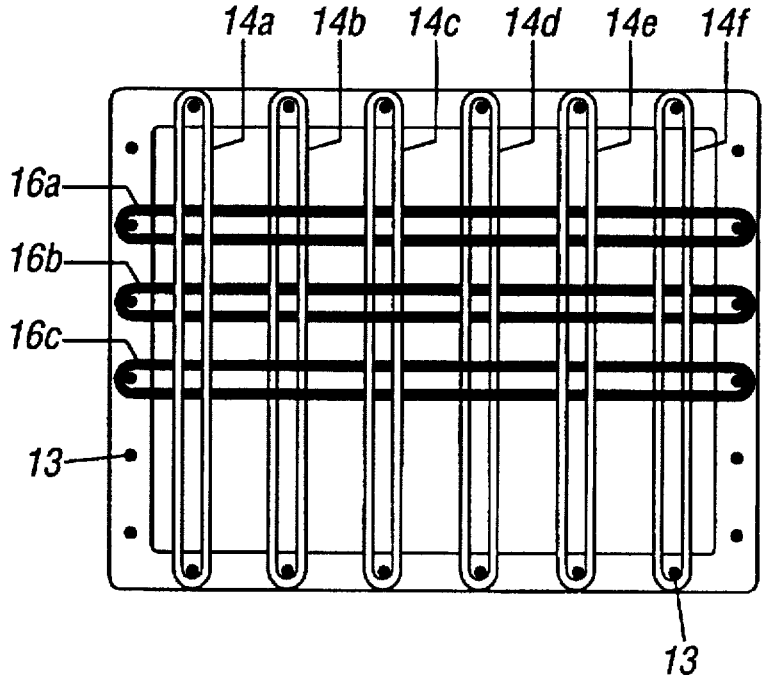
FIG. 5 is a schematic depiction of a "loom" or "pegboard" useful for weaving the strands of netting according to the present invention.

In order to weave the "grid" shown in FIG. 4, a "loom," such as that shown in FIG. 5, may be used. The loom in FIG. 5 has pegs 13 around a substantially rectangular periphery to hold the ends of the loops 10 during the weaving process. The distance between adjacent pegs 13 may vary depending upon the desired characteristics of the woven fabric and the bulk of the individual strands. In a preferred embodiment, a woven fabric washcloth is manufactured on a loom in which the pegs are located about one inch apart.

The first and second sets of strands preferably are oriented substantially perpendicular to one another; however, a diagonal weave pattern also could be used in which the strands were not oriented perpendicular, or at a 90° angle. The only limitation on the angle of orientation of the strands is that the weave pattern should be sufficient to form a substantially continuous mesh. Of course, since each strand is a straight line, the sum of the angles on either side of a juxtaposed strand will be 180°. Preferably, the angle of orientation between a strand and a juxtaposed strand should be no less than 30°.

Opposed ends of one or more loops 10 may be threaded onto each of the pegs 13 and extended across the loom in a substantially parallel pattern to form a first set of strands 14*a–e*. More than one loop may be used for each strand, if desired, in order to increase the bulk of the woven fabric. After a first set of strands 14*a–e* having a desired bulk is arranged, a second set of strands 16*a–c* may be woven, preferably individually, across the first set of strands. In a preferred embodiment, alternate strands in the second set of strands 16 are woven over and under alternating strands in the first set of strands 14 to result in a grid or woven fabric as depicted in FIG. 4. A weave pattern in which adjacent strands in the first set 14 are woven in a pattern exactly opposite to one anther is herein defined as a "diametrically opposed" weave pattern. The weave pattern shown in FIG. 4—in which a strand in the first set is woven over and then under single strands of the second set and immediately adjacent strands have diametrically opposed weave patterns—is herein defined as a "diametrically opposed single strand alternating weave pattern."

Other weave patterns may be used. For example, a first strand 16*a* in the second set of strands 16 could be woven over two strands 14*a–b* in the first set 14, under a single adjacent strand 14*c*, over the next two strands 14*d–e*, etc., in a repeating sequence. The adjacent strand in the second set preferably should be woven in a "diametrically opposed" weave pattern.

Figure 6:
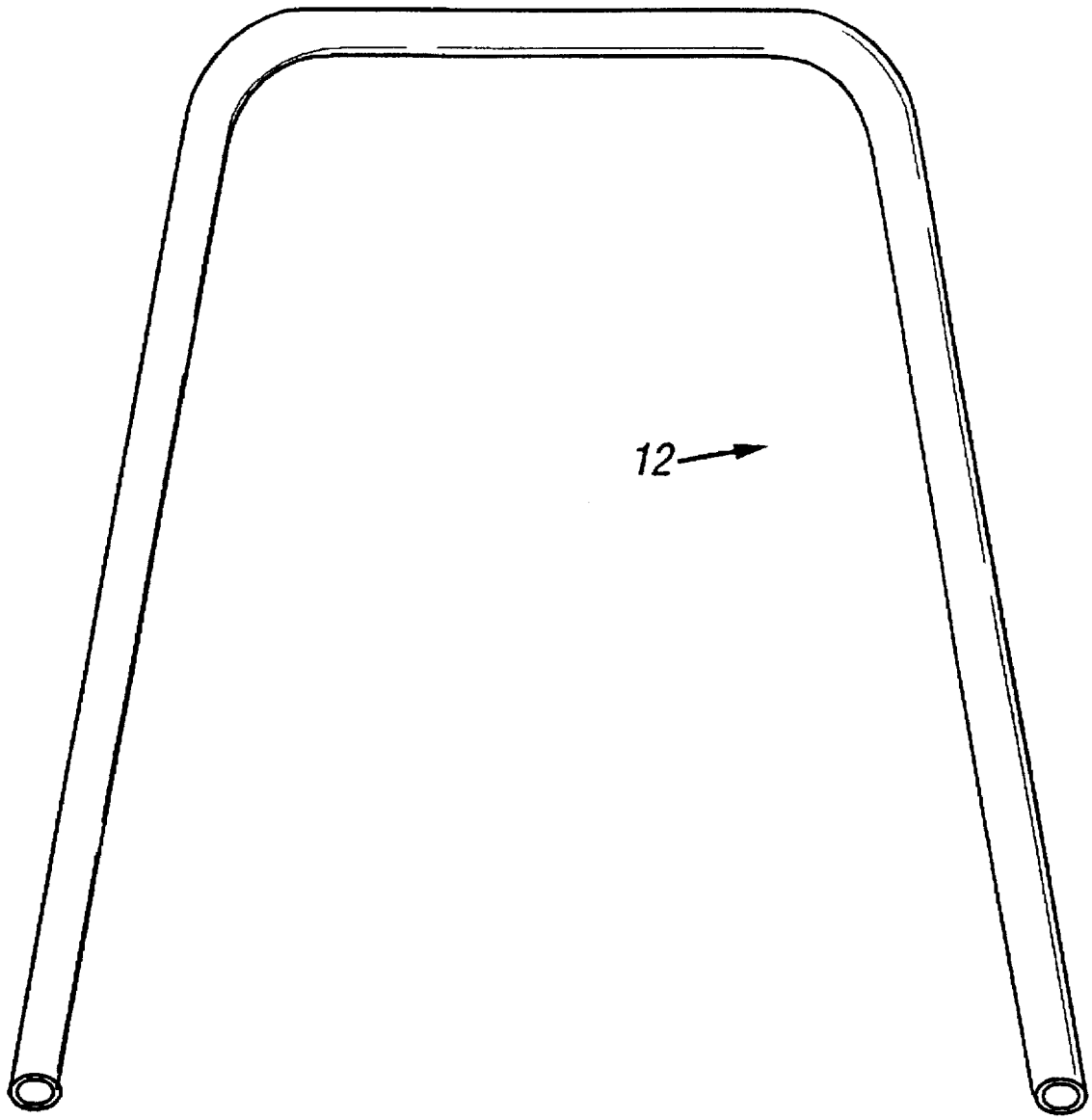
FIG. 6 is a schematic depiction of a mesh fabricator for stretching the loops of FIG. 2 after folding as depicted in FIG. 3.

A preferred embodiment of the present invention is a woven fabric washcloth made of tubular loops of netting, the manufacture of which will now be described in detail. A preferred netting comprises tubular loops of NALTEX™ diamond mesh polyethylene netting, obtained from Nalle Plastics, Inc., 220 E. St. Elmo Road, Austin, Tex. 78745-1218. Preferred tubular netting has a layflat diameter of about 19" and a width of about 5" (B in FIG. 2). The tubular loops of this preferred netting preferably are folded upon themselves along their width (B in FIG. 2) and prestretched to a total diameter (A in FIGS. 1 and 2) of about sixteen inches using a sixteen inch mesh fabricator, as shown in FIG. 6. Sixteen loops of netting are threaded, preferably one per peg, onto pegs positioned about one inch apart on a loom, forming a first set of strands having a substantially parallel orientation. One loop of netting, preferably of a complimentary color, is threaded onto a peg at one end of the loom that has a perpendicular orientation to the end of the loom holding the first set of strands (see FIG. 5). This one loop of netting forms the first strand of the second set of strands. This first strand is woven under the first strand in the first set, over the second strand, under the third strand, and so forth, in an alternating, repeating pattern. After weaving the strand over or under the last strand in the first set, the free end is secured over the peg at the opposite end of the loom, resulting in a first set of substantially parallel strands having a first strand of a second set alternately woven over and under the strands in the first set at a substantially perpendicular angle. Thereafter, one loop of netting is threaded onto the second sequential peg for the second strand in the second set, and the second strand formed thereby is woven in a diametrically opposed pattern to the first strand in the second set. The sequence is repeated for a total of sixteen strands, forming a grid having 16×16 strands with the diametrically opposed single alternating weave pattern shown in FIG. 4.

Persons of ordinary skill in the art could develop any number of variations on the manner in which the loops are interwoven. The present invention encompasses any interwoven pattern that results in a final product that is bound tightly enough together to form a continuous mesh or "fabric" of plastic netting. The first and second set of loops may be made of plastic having the same or different, preferably complimentary colors, to produce an aesthetically pleasing weave.

A person of skill in the art will recognize that many modifications may be made to the present invention without departing from the spirit and scope of the invention. The embodiments described herein are meant to be illustrative only and should not be taken as limiting the invention, which is defined in the following claims.

We claim:

1. A woven fabric of plastic netting comprising:

a first set of substantially parallel strands of netting; and a second set of substantially parallel strands of netting oriented at an angle to said first set of strands and woven over and under said strands in said first set in a weave pattern sufficient to form a substantially continuous mesh.

2. A woven fabric of diamond mesh polyethylene netting comprising:

a first set of substantially parallel strands of diamond mesh polyethylene netting; and a second set of substantially parallel strands of diamond mesh polyethylene netting oriented at an angle to said first set of strands and woven over and under said strands in said first set in a weave pattern sufficient to form a substantially continuous mesh.

3. The woven fabric of claim 1 wherein said second set of netting strands are oriented substantially perpendicular to said first set of netting strands.

4. The woven fabric of claim 2 wherein said second set of netting strands are oriented substantially perpendicular to said first set of netting strands.

5. The woven fabric of claim 1 wherein said weave pattern is a diametrically opposed single alternating weave pattern.

6. The woven fabric of claim 2 wherein said weave pattern is a diametrically opposed single alternating weave pattern.

7. The woven fabric of claim 3 wherein said weave pattern is a diametrically opposed single alternating weave pattern.

8. A woven fabric of diamond mesh polyethylene netting comprising:

a first set of substantially parallel strands of diamond mesh polyethylene netting; and a second set of substantially parallel strands of diamond mesh polyethylene netting oriented substantially perpendicular to said first set of strands and woven over and under said strands in said first set in a diametrically opposed single alternating weave pattern.

9. The woven fabric of claim 1 wherein said weave patterns of alternate strands in said second set are diametrically opposed.

10. The woven fabric of claim 2 wherein said weave patterns of alternate strands in said second set are diametrically opposed.

11. The woven fabric of claim 3 wherein said weave patterns of adjacent strands in said second set are diametrically opposed.

12. The woven fabric of claim 4 wherein said weave patterns of adjacent strands in said second set are diametrically opposed.

13. The woven fabric of claim 1 wherein said strands comprise loops of netting.

14. The woven fabric of claim 2 wherein said strands comprise loops of netting.

15. The woven fabric of claim 3 wherein said strands comprise loops of netting.

16. The woven fabric of claim 4 wherein said strands comprise loops of netting.

17. The woven fabric of claim 5 wherein said strands comprise loops of netting.

18. The woven fabric of claim 6 wherein said strands comprise loops of netting.

19. The woven fabric of claim 1 wherein said strands comprise tubular loops of netting.

20. The woven fabric of claim 2 wherein said strands comprise tubular loops of netting.

21. The woven fabric of claim 3 wherein said strands comprise tubular loops of netting.

22. The woven fabric of claim 4 wherein said strands comprise tubular loops of netting.

23. The woven fabric of claim 5 wherein said strands comprise tubular loops of netting.

24. The woven fabric of claim 6 wherein said strands comprise tubular loops of netting.

* * * * *